United States Patent [19]

Güntert et al.

[11] Patent Number: 4,708,114

[45] Date of Patent: Nov. 24, 1987

[54] FUEL INJECTION PUMP FOR INTERNAL COMBUSTION ENGINES

[75] Inventors: Josef Güntert, Gerlingen; Walter Häfele, Fellbach; Helmut Tschöke, Ostfildern, all of Fed. Rep. of Germany

[73] Assignee: Robert Bosch GmbH, Stuttgart, Fed. Rep. of Germany

[21] Appl. No.: 800,629

[22] Filed: Nov. 21, 1985

[30] Foreign Application Priority Data

Dec. 24, 1984 [DE] Fed. Rep. of Germany ..... 3447374

[51] Int. Cl.[4] ..... F02M 59/34

[52] U.S. Cl. ..... 123/449; 123/500; 417/494

[58] Field of Search ..... 123/449, 500, 501, 503; 417/494, 499

[56] References Cited

U.S. PATENT DOCUMENTS

| | | | |
|---|---|---|---|
| 2,147,390 | 2/1939 | Vaudet | 123/139 |
| 2,746,443 | 5/1956 | Meyer | 123/449 |
| 3,312,209 | 4/1967 | Chmura | 123/449 |
| 3,439,655 | 4/1969 | Eyzat | 123/495 X |
| 3,712,763 | 1/1973 | Parks | 417/499 |

FOREIGN PATENT DOCUMENTS

| | | | |
|---|---|---|---|
| 3018791 | 10/1981 | Fed. Rep. of Germany | 123/449 |

*Primary Examiner*—Tony M. Argenbright
*Attorney, Agent, or Firm*—Edwin E. Greigg

[57] ABSTRACT

A fuel injection pump for internal combustion engines is proposed, in which for normal engine operation the control of the injection quantity and of the beginning and end of supply for injection is effected by means of a control slide which is axially displaceable on the pump piston and in which a radial bore (connecting conduit) controlled by the pump piston is present in the pump cylinder, with which radial bore the pump work chamber can be made to communicate with the suction chamber of the pump. The latest end of supply for the injection is determined in that after a predetermined stroke of the pump piston a relief conduit is arranged to coincide with the radial bore and thereby relieve the pump work chamber. Because the radial bore is only blocked after a pre-stroke has been executed by the pump piston the earliest supply onset also can be controlled with this bore as well.

20 Claims, 10 Drawing Figures

Fig.1
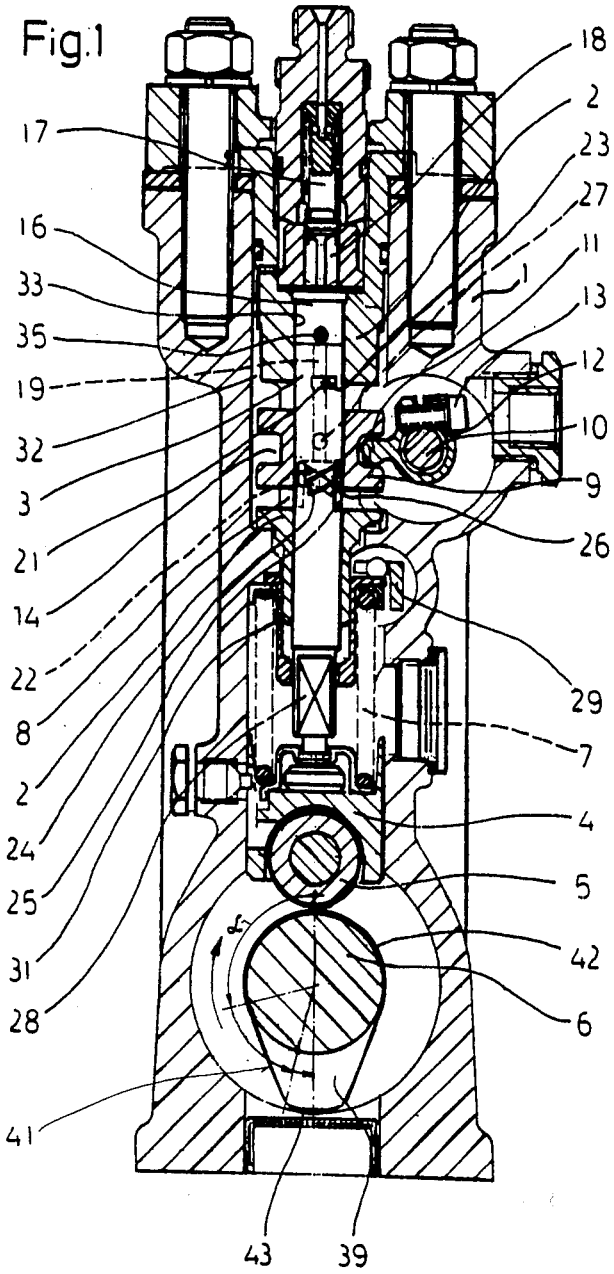
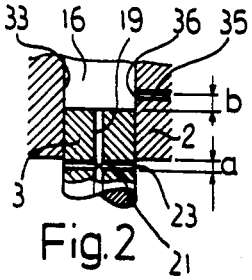
Fig.2
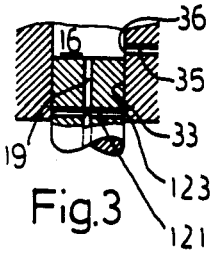
Fig.3
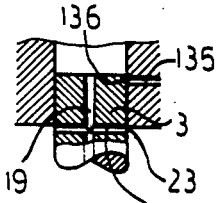
Fig.4
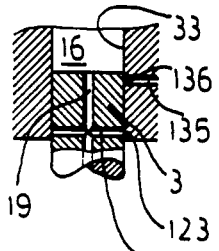
Fig.5

FUEL INJECTION PUMP FOR INTERNAL COMBUSTION ENGINES

BACKGROUND OF THE INVENTION

The invention is based on a fuel injection pump as generally defined hereinafter. Slide-controlled pumps are primarily used for high-capacity output at high pressures, that is, for relatively large engines operating at slower speeds. Accordingly, deviations from the set-point injection values not only lead to poorer engine operation, but may very easily cause expensive engine damage. This danger exists whenever a failure of the control slide actuating device moves the control slide into an extreme position, in which either the injection pump injects an excessive fuel quantity, causing the engine to race, or else the onset or end of supply, determined in these pumps by the position of the control slide, causes the fuel to be injected into the engine cylinder too early or too late, which as is well known can cause thermal or mechanical overloading of the engine. Thermal overloading, in particular, causes a loss in power.

In a known fuel injection pump of the above general type, U.S. Pat. No. 3,712,763, the connecting conduit is embodied as a bore in the pump cylinder liner; it discharges into a suction chamber, surrounding this cylinder liner, of the injection pump and is blocked by the pump piston after a pre-stroke has been executed, after which the pumping of fuel to the engine can begin. Toward the end of the intake stroke and at bottom dead center of the pump piston, the pump work chamber is filled with fuel via this bore, while during the compression stroke of the pump the position of the bore determines the supply onset. The end of supply, and hence the supply quantity, is determined by the position of the control slide at that time. The opening of a quantity control conduit, which extends in the pump piston, emerges from the inner bore of the control slide to establish the end of supply. The farther the control slide is displaced, on the pump piston, toward the pump work chamber, the later will the injection be interrupted and thus the larger is the supply quantity. Hence in an extreme position of the control slide, the pump piston continues to up until reaching, or approaching close to, its top dead center position. In the drive mechanism for driving the pump piston of these slide-controlled pumps, a roller of a roller tappet, coupled with the pump piston, rolls off a cam track of a drive cam; during the high-pressure pumping, the roller rolls off on not only the cam track having a virtually straight cross section, but also on curved tracks adjoining the straight one. Within these curved tracks the cyclical pressures between the roller and the track are considerably higher. That is, while in the straight portion of the track a straight line is facing the roller circle, when the curved cam track is being traversed two circular tracks face one another, and depending on the elasticity of the material the resultant linear contact surface is considerably narrower than if a straight track and a roller are facing one another. At high pressures, which are usual with these pumps, this can cause an overload on the material and thus may destroy the drive mechanism of the injection pump. Quite aside from this, the use of this curved portion of the drive cam for high-pressure pumping also has disadvantages for the injection characteristic, because in this range the supply quantity varies greatly per angle of rotation of the camshaft and decreases down to zero. This decrease does not occur in the normal rpm range, such as the partial-load range; instead, the quantity is determined by a sharply-defined diversion effected by the emergence of the opening of the quantity control conduit from the control slide. In the threshold range described, however, the quality of the fuel injection worsens toward the end of the pump piston stroke, with all the attendant disadvantages in terms of engine operation.

In another known slide-controlled fuel injection pump, although one lacking a connecting conduit in the pump cylinder (U.S. Pat. No. 2,147,390), the onset and end of supply are determined by the axial position of the control slide, but contrarily the supply quantity is determined by rotating the pump piston; to this end, in the usual manner, an oblique control edge located in either the control slide or the pump piston cooperates with a bore provided in the opposing part. In this pump as well, there is the danger that in extreme positions of the control slide damage to the engine or to the pump drive mechanism as described above, can occur, or that the engine operation will be associated with the abovementioned disadvantages.

OBJECT AND SUMMARY OF THE INVENTION

The fuel injection pump according to the invention has the advantage over the prior art that the effective supply of fuel to the engine is terminated after a predetermined pumping stroke has been executed, regardless of the fuel control effected by the control slide. As a result, the maximum possible supply quantity of the injection pump is limited at the same time, which in particular prevents engine racing. It is also possible to assure that by opening the relief conduit at the proper time, the high-pressure pumping is terminated before the roller of the roller tappet moves from the straight (tangential) portion onto the curved portion of the drive cam of the injection pump. A dangerous shift of the instant of the end of supply toward "late", with the attendant above-described disadvantages, is prevented by the invention without attendant disadvantages in terms of fuel quantity control or engine operation. By proper arrangement of the control slide quantity control, it is advantageously possible to reduce the fuel supply to zero if the control slide assumes an undesirable extreme position. This is attained by providing that the relief conduit uncovers the connecting conduit disposed in the pump cylinder before the quantity control conduit opening moves into the control slide to effect the supply onset.

In accordance with the invention, the location of the entrance of the connecting conduit in the pump cylinder can be variably arranged with respect to the location of the pump piston controlling it. In an advantageous embodiment of the invention, the connecting conduit also controls the earliest possible supply onset, in that the entrance of the connecting conduit is blocked only after a pre-stroke of the pump piston is executed, so that only thereafter is it possible to build up a pressure in the pump work chamber. The connecting conduit then additionally serves as a way of filling up the pump work chamber, that is, as long as the pump piston is in the vicinity of its bottom dead center position. The opening of the relief conduit can either always remain inside the bore of the pump cylinder that receives the pump piston, or it may also emerge from the pump cylinder, which has the advantage that then the pump work chamber can also be filled up at bottom dead center of the pump piston. In that case, however, after the pump piston has executed its maximum working stroke the entrance of the connecting conduit is uncovered by the opening of the relief conduit, in order to interrupt the supply of fuel to the engine. In this manner, the maximum supply stroke, and hence the maximum supply quantity, are limited by the relief conduit and the connecting conduit, and in addition an excessively early supply onset is prevented. As is well known, an overly early supply onset is usually more damaging to the engine than an overly late one.

According to another feature of the invention, the entrance of the connecting conduit is covered by the jacket face of the pump piston, and it is uncovered by the opening of the relief conduit after the pump piston has executed the predetermined stroke. An arrangement of this kind is of interest primarily if the connecting conduit leads not to the suction chamber but only to an drainage collection chamber. Here again, the opening of the relief conduit disposed on the pump piston can enter the bore of the pump cylinder only after a predetermined pre-stroke, or else it may remain always inside the bore of the pump cylinder that receives the pump piston, or in other words not emerge from the pump cylinder at all in the portion of the stroke located about bottom dead center. In the first case, the supply onset can be determined by the entry of the opening into this bore, while in the second case the supply onset must be attained by other means, such as the quantity control slide.

According to further features of the invention, the opening of the relief conduit can be embodied to suit various purposes and hence in a variable manner. The opening may be embodied as an annular groove, or as a transverse groove which then communicates with the pump work chamber via a transverse bore and a longitudinal bore extending within the pump piston. If the pump piston is rotatable in order to vary the fuel quantity, then the upper limiting edge of the control groove may be stepped and/or oblique with respect to the axis of the pump piston, so that a rotation of the pump piston effects a change in the uncovering stroke between the relief conduit opening and the connecting conduit entrance. As a result, the latest possible end of supply can be varied as well in association with a variation of the supply quantity The invention will be better understood and further objects and advantages thereof will become more apparent from the ensuing detailed description of a preferred embodiment, taken in conjunction with the drawings.

BRIEF DESCRIPTION OF THE DRAWINGS

FIG. 1 is a longitudinal section taken through a fuel injection pump according to the invention;

FIGS. 2–5 show various associations of the connecting conduit and relief conduit, in an enlarged detail of FIG. 1;

DESCRIPTION OF THE PREFERRED EMBODIMENT

Figure 6:
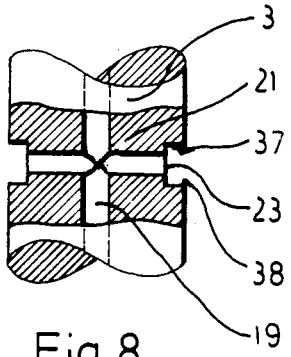
FIGS. 6–9 show three variants of the relief conduit opening on one piston section.
Figure 7:
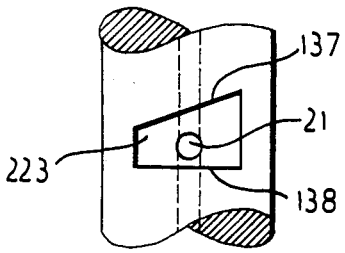

In the fuel injection pump shown in FIG. 1, there is a plurality of cylinder liners 2—only one of which is shown—inserted in a line into the housing 1. Inside the cylinder liners 2, pump pistons 3 are driven, with an interposed roller tappet 4 having a roller 5, by a camshaft 6 counter to the force of a spring 7 in order to effect their axial movement that embodies the working stroke. A recess 8 is present in the cylinder liner 2, receiving a control slide 9 that is axially displaceable on the pump piston 3. The individual control slides 9, of which again only one is shown, which are slidably disposed on the respective pump pistons, are displaced axially in common by a governor rod 10. To this end, the governor rod 10 is rotatably supported in the housing 1 and has a driver member, in the form of a clamping ring 12 provided with a head 11, for each control slide 9. The clamping ring 12 is firmly clamped to the governor rod 10 by a tightening screw 13, and the head 11 engages an annular groove 14 of the control slide 9.

The pump piston 3 and the cylinder liner 2 define a pump work chamber 16, from which a pressure conduit 17 in which an adaptation valve 18 is disposed leads to a pressure line, not shown, which ends at an injection nozzle of the internal combustion engine.

A blind bore 19 discharging into the pump work chamber 16 and two transverse bores 21 and 22, of which the transverse bore 21 is shown only in plan view in FIG. 1, are provided in the pump piston. The transverse bore 21 discharges into a transverse groove 23 provided in the jacket face of the pump piston 3; in this variant embodiment shown in FIG. 1, this groove 23 is embodied by machining the jacket face of the piston. The transverse groove 21, the portion of the blind bore 19 leading to the pump work chamber, and the transverse groove 23 together form a relief conduit. The second transverse bore 22 discharges into two oblique grooves 24 and two longitudinal grooves 25, also disposed on the jacket face of the pump piston 3, which in combination with the control slide 9 and its inner bore 26, as well as a relief bore 27 disposed in the control slide 9, serve to control the supply quantity.

The pump piston 3 has a flattened area 28 on its lower end, which is engaged by a driver member 31 that is rotatable in a known manner by a governor rod 29, so that an axial displacement of the governor rod 29 results in a rotation of the pump piston 3.

In its middle portion, which also has the recess 8, the cylinder liner 2 is surrounded by a suction chamber 32 provided in the housing 1 and filled with fuel at low pressure. Thus this suction chamber 32 also communicates with the grooves 23, 24 and 25 as long as they are not covered by the control slide 9 or the pump cylinder 33 of the cylinder liner 2. A radial bore 35 is located in the cylinder liner 2 and serves as a connecting conduit, which joins the pump work chamber 16 to the suction chamber 32 as long as the radial bore 35 is not blocked by the pump piston 3.

OPERATION

The fuel injection pump shown in FIG. 1 functions as follows:

During at least a portion of the intake stroke of the pump piston 3 and in the vicinity of the bottom dead center point of its stroke, fuel flows out of the suction chamber 32 into the pump work chamber 16 via the openings serving to control fuel quantity, namely the oblique grooves 24, the longitudinal grooves 25 and the bores 27, on the one hand, and the connecting conduit 35 as well as the relief conduit 19, 21, 23 on the other.

During the ensuing compression stroke of the pump piston 3, the pressure required for the injection does not build up in the pump work chamber 16 until the inflow conduits between the suction chamber 32 and the pump work chamber 16 are blocked. During this time, fuel is pumped back to the pump suction chamber 32 from the pump work chamber 16 via these conduits. The closure of the quantity control conduits during the compression stroke is dependent on the axial position of the control slide 9 and on the rotational position of the pump piston 3. Contrarily, the blocking of the relief conduit 19, 21, 23 or of the connecting conduit 35 is dependent solely on the stroke position of the pump piston 3, so that this control should be considered independently of that effected by the control slide 9.

By means of the control slide 9, the quantity of fuel pumped to the engine is controlled in the usual manner, in that depending on the rotational position of the pump piston and hence depending on the distance between the upper control edge of the oblique grooves 24 and the relief bore 27, a variably long stroke of the pump piston 3 must be executed before the high-pressure supply and hence the injection are terminated by the uncovering of this quantity control conduit formed by the blind bore 19, the transverse bore 22 and the grooves 24, 25. A pressure that is sufficient for injection cannot build up in the pump work chamber 16 until the longitudinal grooves 25 have entered the bore 26 of the control slide 9. To vary the injection quantity, the governor rod 29 is axially displaced by an rpm governor, which is not shown and which may operate by mechanical or electrical means, which brings about a rotation of the driver member 31 and pump piston 3.

The timing of this effective supply stroke, serving the purpose of injection, can be shifted by axially displacing the control slide 9. The farther upward the control slide 9 is displaced, the more the effective supply stroke is shifted toward later, and the farther the control slide 9 is displaced downward, the earlier the effective supply stroke will begin with respect to the rotational position of the camshaft 6 at this time, the camshaft 6 being driven at the same rpm as the crankshaft of the engine supplied by the pump.

This shift in the timing of the effective supply stroke by displacing the control slide 9 is performed during normal engine operation and it functions satisfactorily only if the control slide 9 is not displaced into its extreme upper or lower position inside the recess 8; this may happen occur by its own weight if the drive of the governor rod 10 controlling the injection onset fails, or if an electrical control unit which may be used should fail and displace the control slide 9 farther upward than its normal operating range. Displacing the control slide 9 into the lower extreme position causes a premature supply onset, which can cause the destruction of the engines generally supplied by this type of injection pump, unless counteractive safety precautions are taken. Displacing the control slide 9 into the upper extreme position, with the associated belated supply onset, can cause overheating, and again the destruction of the engine, unless safety precautions are taken. The engines here are particularly imperiled in the full-load range, that is, when the maximum possible injection quantity is being supplied.

According to the invention, this danger is avoided by using the connecting conduit 35 in cooperation with the relief conduit 19, 21, 23. The earliest supply onset and the latest end of supply, and thus at the same time the maximum possible effective supply stroke of the pump piston 3, are determined by the location of the entrance 36 of the connecting conduit 35 in the pump cylinder 33 and by the location of the opening 23 (transverse groove) of the relief conduit 19, 21 in the jacket face of the pump piston 3. FIGS. 2–5 show four different variants of this possible association of the entrance 36 and the opening 23, on an enlarged scale.

The association of the conduits shown in FIG. 2 corresponds with what is shown in FIG. 1. After the stroke a of the pump piston 3 has been executed, the opening 23 is blocked by the pump cylinder 33, and only after the stroke of the pump piston 3 continues and the somewhat longer travel b has been executed is the entrance 36 of the connecting conduit 35 blocked. Only when both conduits are blocked can a buildup of the pressure required for injection take place in the pump work chamber 16. This is finally dependent on whether the quantity control conduit, which is controlled by the control slide 9, has already been blocked as well. For instance, it is possible that after this stroke b the longitudinal grooves 25 may not yet have entered all the way into the control slide 9 (as is the case, for example, in the control slide position shown in FIG. 1). If the control slide 9 were to assume one of the extreme positions, however, a premature injection onset would not be possible, because the earliest injection onset (effective supply onset) is determined by the blocking of the connecting conduit 35, and this earliest-possible injection onset is selected such that damage to the engine cannot occur.

The effective supply stroke of the pump piston 3 can at most be long enough that the opening 23 of the relief conduit 19, 21, 23 comes to coincide with the entrance 36 of the connecting conduit 35. This limits the maximum possible supply quantity per injection stroke, as well as the latest-possible end of supply. On the one hand, this avoids the injection of an impermissibly large quantity of fuel in the extreme positions of the control slide, and on the other hand, it assures that, because the end of supply is independent of the position of the control slide 9, the supply quantity is reduced if the supply onset determined by the control slide 9 is overly late. In other words, if the control slide 9 assumes its upper extreme position, at which it effects a late supply onset, then at this supply onset the entrance 36 to the connecting conduit 35 is already blocked; the result is an early uncovering by the relief conduit 19, 21, 23, which correspondingly effects a reduction in the injection quantity. The association of these control provisions can be selected such that at least in one of the extreme positions of the control slide 9, no further fuel is injected by the pump.

As in the variant shown in FIG. 2, the pump piston in the variants shown in FIGS. 3–5 is also shown in its bottom dead center, corresponding to FIG. 1. In the variant shown in FIG. 3, the opening 123 of the transverse bore 121 of the relief conduit 19, 121, 123 does not emerge from the cylinder bore 33 at bottom dead center either, so that this relief conduit cannot also take on the function of filling up the pump work chamber 16. Otherwise the function is the same as that described above, because the supply onset is determined only upon the covering of the entrance 36 of the connecting conduit 35 by the pump piston, and the latest-possible end of supply is determined by the uncovering of this conduit by the opening of the transverse bore 123. In this variant, as compared with the exemplary embodiment described in conjunction with FIGS. 1 and 2, either the effective supply stroke can be shortened, or the pump cylinder can be lengthened toward the pump piston 3, for instance so that the coincidence will be of longer duration. In the variant of FIG. 4, the entrance 136 of the connecting conduit 135 is blocked by the pump piston 3 at bottom dead center as well, so that the supply onset is determined by the relief conduit 19, 21, 23, and the end of supply is determined by the coincidence of the opening 23 and the entrance 136 of the conduits. In this variant as well, the maximum possible effective supply stroke is determined by the entrance 136 of the connecting conduit 135 and the opening 23 of the relief conduit 19, 21.

In the third variant shown in FIG. 5, the opening 123 of the relief conduit 19, 121 and the entrance 136 of the connecting conduit 135 remain blocked at bottom dead center by the pump cylinder 33 and the pump piston 3. The earliest supply onset must therefore be controlled by other means. The end of supply, however, and thus the maximum possible supply quantity, are determined as in the other variants by the position of the opening 123 and the entrance 136. In this variant, the conduits 19, 121 and 135 cannot be used to fill the pump work chamber 16 during the intake stroke or at bottom dead center of the pump piston 3.

FIGS. 6–9 show four different realizations of the openings of the transverse bore 21 on only one section of the pump piston 3. In FIG. 6, the view shown of FIG. 1 is enlarged and shown in a fragmentary section, rotated by 90° about the axis of the pump piston. The transverse groove 23, which is shown in plan view in FIG. 1, appears here in section. The limiting edges of this transverse groove 23 are embodied in straight lines, the upper control edge 37 of controlling the end of injection by uncovering the entrance 36 of the connecting conduit 35 and the lower control edge 38, in the variant according to FIG. 4, onset in cooperation with the pump cylinder 33. In the variant of FIG. 7, the opening is again embodied as a flattened area 223 shown in plan view, into which the transverse bore 21 discharges, and the upper and lower limiting edges 137 and 138 of which, in contrast to the example shown in FIG. 6, extend not parallel to one another but instead form an angle with one another. As a result, the earliest supply onset and/or the latest end of supply and hence the maximum effective supply stroke can be varied by rotating the pump piston.

Figure 8:
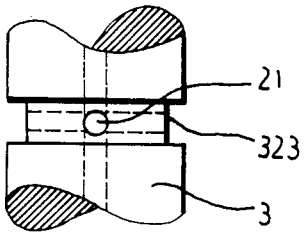
Figure 9:
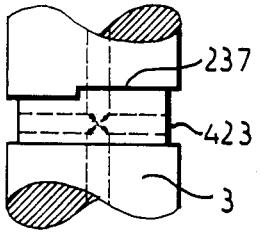

In the variant shown in FIG. 8, the opening of the transverse bore 21 is embodied as an annular groove with parallel limiting edges which is machined into the jacket face of the pump piston 3. In the variant shown in FIG. 9, the upper limiting edge 237 of this annular groove 423 is stepped, so that as a result, the end of supply is also variable in accordance with load depending on the rotational position of the pump piston 3. Naturally an appropriately oblique control edge can also be provided, instead of a stepped one.

The allowable load on cam drives is determined by the maximum permissible cyclical pressures occurring there between the driving portion (the cam) and the driven portion (the roller). The larger the contact surface for transmitting force between the driving portion and the driven portion, the lower are the cyclic pressures at the same load, and thus the greater is the maximum force that can be transmitted, given the same material. Accordingly, as long as the roller 5 of the roller tappet 4 rolls off a curved track of the cam 39 (see FIG. 1), the maximum transmissible forces are lower than if the roller 5 is rolling off on the straight portion 41, the so-called tangential area, of the cam 39. According to the invention, it is attained that for the effective useful stroke the roller 5 of the roller tappet 4 rolls off only the tangential area 41 of the cam 39. In FIG. 1, the cam 39 is just now pointing downward (bottom dead center of the pump piston 3), so that the roller 5 of the roller tappet 4 is substantially resting on the basic circle 42. If the camshaft 6 rotates in the direction of the arrow, then in this specialized example, for a rotational angle $\alpha$ of up to approximately 115° of crankshaft rotation, the pump piston remains in the bottom dead center position shown. Within this period, the pump work chamber 16 is filled up with fuel. For the ensuing rotational angle, in this case up to approximately 160° of crankshaft angle, the roller 5 rolls on the straight portion 41 of the cam 39. This is adjoined by a curved portion 43 of the cam 39, shortly before the pump piston then, after 180° of crankshaft angle, assumes its top dead center position. This is then followed by the intake stroke of the pump piston, again at 180° of crankshaft rotation.

Figure 10:
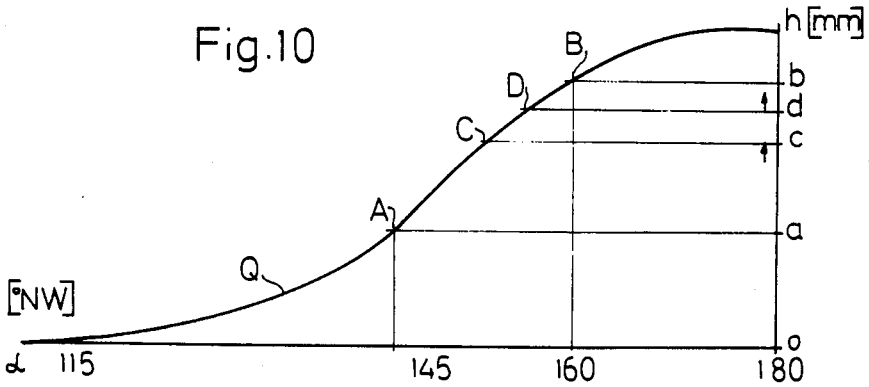
FIG. 10 is a function diagram.

In the diagram shown in FIG. 10. the stroke h of the pump piston (3) is plotted on the ordinate, over the rotational angle $\alpha$ in ° NW (degrees of crankshaft rotation) on the abscissa. Q indicates the supply curve of the pump, which is derived from the fact that the positive displacement of fuel by the pump piston 3 begins at $\alpha \approx 115°$ NW and initially rises only gradually, so that a uniform supply per angle of rotation is attained only at $\alpha \approx 145°$ NW. This uniform supply ceases at $\alpha \approx 160°$ NW, after which the supply then decreases until top dead center. The uniformly high pressure required for injection can accordingly be attained only in the crankshaft angle range between $\alpha \approx 145°$ and 160° NW This portion of the track is defined in FIG. 10 by points A and B, which corresponds to a piston stroke between h=a and h=b (on the ordinate h). If the pump piston has executed the stroke a, the entrance 36 of the connecting conduit 35 is therefore, according to the invention, just now blocked, so that only now can an injection pressure build up in the pump work chamber 16, as long as the quantity control conduit, as described earlier herein, has already been blocked at this instant. Then once the pump piston has traversed the total stroke b, the high pressure prevailing in the pump work chamber 16 and correspondingly the great force of the roller 5 on the cam 39 are reduced, in that the opening 23 of the relief conduit 19, 21 uncovers the connecting conduit 35 once again.

The control slide 9 can thus determine the onset and/or the end of supply only for such time, and within this range between points a and b, as the earliest supply onset or the latest end of supply are not already taking place or have not already taken place as a result of the control effected between the relief conduit 19, 21 and/or the connecting conduit 36. In terms of FIG. 10, this means that in the piston stroke segments $\leqq$ a and $\geqq$ b, the onset and end of supply cannot be influenced by the control slide 9.

Thus if the control slide 9 is displaced into an extreme lower position in the direction of an early injection, then the supply onset cannot begin, even if the longitudinal groove 25 is already blocked, until the stroke a has been traversed by the pump piston. Depending on the rotational position of the piston, that is, on the maximum supply quantity set, injection cannot occur after this stroke a until, after the stroke c, for instance, has been traversed, the relief bore 27 in the control slide 9 is uncovered by the oblique groove 24, which causes a corresponding pressure buildup in the pump work chamber 16. Thus the tangential range of the curve Q between the points A and C is used for the effective fuel supply. The earlier the longitudinal groove 25 of the quantity control conduit is blocked than the entrance 36 of the connecting conduit, the more the effective supply stroke is shortened, and thus the smaller the injected fuel quantity, which in an extreme case can have the result that the stroke a=the stroke c, so that no high-pressure supply by the pump, and hence no injection, will take place.

Now if the control slide 9 is displaced far upward in the "late" direction, the longitudinal groove 25 of the quantity control conduit also enters the control slide 9 relatively late, for instance after the stroke d has been traversed, and only after that can the high pressure build up in the pump work chamber 16. The effective supply stroke is thus restricted to the stroke portion between d and b, because the pressure in the pump work chamber 16 has already been reduced and hence the injection interrupted at point b via the relief conduit 19, 21 and the connecting conduit 35. For the effective supply stroke, the tangential range of the curve Q between points D and B is accordingly used. Depending on how far the control slide 9 is displaced toward "late", and depending on which rotational position the pump piston assumes, the maximum supply quantity determined by the rotational position is reduced at point B by the opening up of the pump work chamber 16, which in an extreme case can lead to a zero supply situation, for instance if the instant of supply onset D coincides with the instant of the end of supply B—that is, if the connecting conduit 36 uncovers the relief conduit 19, 21 before the longitudinal groove 25 of the quantity control conduit enters the control slide 9.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising at least one pumping unit provided with a pump cylinder having a wall and a pump piston having an opening on a jacket face thereof, said pump cylinder and said pump piston further including an axis and arranged to define a pump work chamber, a control slide axially displaceable on said pump piston, said slide adapted to control a quantity control conduit located in said pump piston, said quantity control conduit arranged to communicate with said pump work chamber, a connecting conduit leading to a chamber of lower pressure controlled by said pump piston independently of said control slide, said pump cylinder wall further provided with an entrance therein that is capable of being covered by said pump piston and said pump piston further including a relief conduit adatped to communicate with said pump work chamber, whereby after a predetermined compression stroke of said pump piston has been traversed, said opening of said relief conduit is adapted to uncover said entrance of said connecting conduit, and said opening of said relief conduit is arranged to emerge from said pump cylinder at least at bottom dead center of said pump piston.

2. A fuel injection pump as defined by claim 1, in which said quantity control conduit and said relief conduit share a central blind bore in said piston and each of said conduits further include a transverse bore which extends transversely to said blind bore.

3. A fuel injection pump as defined by claim 1, in which a control groove in said jacket face of said pump piston extends substantially transversely to a stroke direction of said piston and serves as said opening of said relief conduit.

4. A fuel injection pump as defined by claim 2, in which a control groove in said jacket face of said pump piston extends substantially transversely to a stroke direction of said piston and serves as said opening of said relief conduit.

5. A fuel injection pump as defined by claim 3, in which said control groove comprises an annular groove.

6. A fuel injection pump as defined by claim 5, in which said control groove in said pump piston further includes an upper limiting edge, said upper limiting edge extending obliquely with respect to said pump piston axis, so that a rotation of said pump piston causes a variation of the uncovering stroke between said relief conduit opening and said connecting conduit entrance.

7. A fuel injection pump as defined by claim 3, in which a machine cut in said piston jacket face serves as said control groove.

8. A fuel injection pump as defined by claim 7, in which said control groove in said pump piston further includes an upper limiting edge, said upper limiting edge extending obliquely with respect to said pump piston axis, so that a rotation of said pump piston causes a variation of the uncovering stroke between said relief conduit opening and said connecting conduit entrance.

9. A fuel injection pump as defined by claim 5, in which said control groove in said pump piston further includes an upper limiting edge, said upper limiting edge being stepped with respect to said pump piston axis, so that a rotation of said pump piston causes a variation of the uncovering stroke between said relief conduit opening and said connecting conduit entrance.

10. A fuel injection pump as defined by claim 7, in which said control groove in said pump piston further includes an upper limiting edge, said upper limiting edge being stepped with respect to said pump piston axis, so that a rotation of said pump piston causes a variation of the uncovering stroke between said relief conduit opening and said connecting conduit entrance.

11. A fuel injection pump as defined by claim 1, in which during normal engine operation, the injection quantity can be determined by rotating said pump piston and the onset and end of supply can be determined by displacing said control slide.

12. A fuel injection pump as defined by claim 1, in which said pump piston is driven by a cam means, said cam means having a substantially straight portion, partially effecting a tangential range in the drive curve (Q), and that for the effective supply stroke only this tangential range is used.

13. A fuel injection pump as defined by claim 2, in which said pump piston is driven by a cam means, said cam means having a substantially straight portion, partially effecting a tangential range in the drive curve (Q), and that for the effective supply stroke only this tangential range is used.

14. A fuel injection pump as defined by claim 1, in which said entrance of said connecting conduit is blockable at the beginning of the compression stroke only after a predetermined pre-stroke has been traversed by said pump piston.

15. A fuel injection pump as defined by claim 14, in which said pump piston has an effective supply stroke which is determined by the location of said opening of said relief conduit and of said entrance of said connecting conduit.

16. A fuel injection pump as defined by claim 14, in which during normal engine operation, the injection quantity can be determined by rotating said pump piston and the onset and end of supply can be determined by displacing said control slide.

17. A fuel injection pump as defined in claim 15, in which during normal engine operation, the injection quantity can be determined by rotating said pump piston and the onset and end of supply can be determined by displacing said control slide.

18. A fuel injection pump for internal combustion engines comprising at least one pumping unit provided with a pump cylinder having a wall and a pump piston having an opening on a jacket face thereof, said pump cylinder and said pump piston further including an axis and arranged to define a pump work chamber, a control slide axially displaceable on said pump piston, said slide adapted to control a quantity control conduit located in said pump piston, said quantity control conduit arranged to communicate with said pump work chamber, a connecting conduit leading to a chamber of lower pressure controlled by said pump piston independently of said control slide, said pump cylinder wall further provided with an entrance therein that is capable of being covered by said pump piston and said pump piston further including a relief conduit adapted to communicate with said pump work chamber, whereby after a predetermined compression stroke of said pump piston has been traversed, said opening of said relief conduit is adapted to uncover said entrance of said connection conduit, and said entrance of said connecting conduit is blockable at the beginning of the compression stroke only after a predetermined pre-stroke has been traversed by said pump piston.

19. A fuel injection pump for internal combustion engines comprising at least one pumping unit provided with a pump cylinder having a wall and a pump piston having an opening on a jacket face thereof, said pump cylinder and said pump piston further including an axis and arranged to define a pump work chamber, a control slide axially displaceable on said pump piston, said slide adapted to control a quantity control conduit located in said pump piston, said quantity control conduit arranged to communicate with said pump work chamber, a connecting conduit leading to a chamber of lower pressure controlled by said pump piston independently of said control slide, said pump cylinder wall further provided with an entrance therein that is capable of being covered by said pump piston and said pump piston further including a relief conduit adapted to communicate with said pump work chamber, whereby after a predetermined compression stroke of said pump piston has been traversed, said opening of said relief conduit is adapted to uncover said entrance of said connecting conduit, a control groove in said jacket face of said pump piston extends substantially transversely to a stroke direction of said piston and serves as said opening of said relief conduit, and said opening of said relief conduit is arranged to emerge from said pump cylinder at least at bottom dead center of said pump piston.

20. A fuel injection pump as defined by claim 19, in which during normal engine operation, the injection quantity can be determined by rotating said pump piston and the onset and end of supply can be determined by displacing said control slide.

* * * * *